US008818571B1

(12) United States Patent
Iida et al.

(10) Patent No.: US 8,818,571 B1
(45) Date of Patent: Aug. 26, 2014

(54) STEERING CONTROL SYSTEM FOR RADIO CONTROL VEHICLE AND A RADIO CONTROLLED CAR COMPRISING THE SAME

(71) Applicant: HPI Racing & HB, Foothill Ranch, CA (US)

(72) Inventors: Hiroyuki Iida, Foothill Ranch, CA (US); Masahide Suzuki, Kawaguti (JP)

(73) Assignee: HPI Racing & HB, Foothill Ranch, CA (US)

( * ) Notice: Subject to any disclaimer, the term of this patent is extended or adjusted under 35 U.S.C. 154(b) by 0 days.

(21) Appl. No.: 13/799,936

(22) Filed: Mar. 13, 2013

(51) Int. Cl.

| | |
|---|---|
| ***G05D 1/00*** | (2006.01) |
| ***G05D 3/12*** | (2006.01) |
| ***G05D 15/01*** | (2006.01) |
| ***A63H 30/04*** | (2006.01) |

(52) U.S. Cl.
CPC ..... *G05D 3/12* (2013.01); *G05D 1/0033* (2013.01); *G05D 15/01* (2013.01); *A63H 30/04* (2013.01)
USPC ..... 701/2; 446/456

(58) Field of Classification Search
CPC ..... G05D 1/00; G05D 1/0016; G05D 1/0033; G05D 3/12; G05D 3/124; G05D 3/1472; G05D 3/20; G05D 15/00; G05D 15/01; A63H 30/00; A63H 30/02; A63H 30/04; H04B 7/24; H04B 7/26
USPC ..... 701/2, 36, 41–44; 446/454, 456, 468; 340/12.22
See application file for complete search history.

(56) References Cited

U.S. PATENT DOCUMENTS

| | | | | |
|---|---|---|---|---|
| 5,707,237 | A | 1/1998 | Takemoto | |
| 5,865,624 | A | 2/1999 | Hayashigawa | |
| 7,885,732 | B2 | 2/2011 | Troy | |
| 8,049,600 | B2 | 11/2011 | Beard | |
| 8,330,583 | B2 * | 12/2012 | Beard et al. | 340/12.22 |
| 8,545,284 | B2 * | 10/2013 | Baarman et al. | 446/444 |
| 2002/0142701 | A1 | 10/2002 | Rosenberg | |
| 2004/0077284 | A1 | 4/2004 | Bonilla et al. | |
| 2006/0164383 | A1 * | 7/2006 | Machin et al. | 345/156 |
| 2007/0035412 | A1 | 2/2007 | Dvorak | |
| 2008/0026671 | A1 | 1/2008 | Smith et al. | |
| 2009/0222168 | A1 | 9/2009 | Egenfeldt | |
| 2011/0054717 | A1 | 3/2011 | Yamauchi | |
| 2011/0275274 | A1 | 11/2011 | Dewitt et al. | |
| 2012/0027049 | A1 * | 2/2012 | Beard et al. | 375/141 |

FOREIGN PATENT DOCUMENTS

| | | | |
|---|---|---|---|
| JP | H10-257575 | A | 9/1998 |
| JP | 2000-126466 | A | 5/2000 |
| JP | 2000-209684 | A | 7/2000 |

(Continued)

*Primary Examiner* — Richard Camby
(74) *Attorney, Agent, or Firm* — Knobbe Martens Olson & Bear LLP

(57) ABSTRACT

A steering control system for a RC vehicle is provided. The steering control system comprises an angular speed sensor and a processing unit. The processing unit is configured to receive a first steering signal from a receiver of the radio controlled vehicle which indicates a position of a control stick or a control wheel of a controller for the radio controlled vehicle and to receive a signal from the angular speed sensor. The first steering signal is adjusted based on the signal from the angular speed sensor and the position of a control stick or a control wheel of a controller to improve stability of the vehicle without deteriorating a maneuverability of the vehicle.

14 Claims, 4 Drawing Sheets

(56) References Cited

FOREIGN PATENT DOCUMENTS

| | | | |
|---|---|---|---|
| JP | 2001-352414 | A | 12/2001 |
| JP | 2002-263368 | A | 9/2002 |
| JP | 2003-38863 | A | 2/2003 |
| JP | 2007-79797 | A | 3/2007 |
| JP | 2010-029724 | A | 2/2010 |

* cited by examiner

STEERING CONTROL SYSTEM FOR RADIO CONTROL VEHICLE AND A RADIO CONTROLLED CAR COMPRISING THE SAME

FIELD OF INVENTION

The present invention generally relates to a steering control system for a radio controlled (RC) vehicle. More particularly, the present invention relates to a steering control system comprising an angular speed sensor to stabilize a vehicle movement and a radio controlled car comprising the same.

BACKGROUND

Radio controlled cars are enjoyed by hobbyists recreationally and also competitively, and drifting is one of many variations of radio controlled car activities. Drifting is a technique to attack a corner by causing a tail (rear wheels) of the car to slide sideways to over-steer while maintaining control of the car. In such circumstances, the front wheels need to be pointing in the opposite direction to the turn, for example, the car is turning left, while the front wheels are pointing right or vice versa, and the car becomes vulnerable to spin out. An experienced user can sense this behavior and maintain control of the car. However, with a conventional radio controlled car, it is a very difficult maneuver for novices.

In order to maintain the control of the car and prevent a spin out, an approach chosen so far in the prior art has been to provide a steering control system utilizing an angular speed sensor. The steering control system having an angular speed sensor is widely used in remotely controlled vehicle to improve stability of the vehicle, especially for stabilizing yaw motion of a helicopter or the like. In the system, a yaw motion is detected by the angular speed sensor and a signal to a steering servo is generated according to the detected angular speed so as to make a corrective move.

The same technique has been employed for a radio controlled toy car. A steering control system including an angular speed sensor is installed between front wheels and rear wheels to detect the angular speed of the car. In this configuration, if rear wheels slide to left (the car is turning right and the angular speed sensor detects a right-hand turn), the system sends a signal to a steering servo to turn the front wheels to the left. This approach has been found also useful to maintain a steady cruising for a high power vehicle or on a slippery surface.

BRIEF SUMMARY OF THE INVENTION

An aspect of the present invention involves the realization that, as the angular speed sensor detects an intentional maneuver, the steering control system acts on such intentional maneuver as well. As such, the conventional steering control system keeps the vehicle always in an under-steer condition and deteriorates vehicle maneuverability, such as by creating a larger minimum turning radius. Further, a demand for a level of assist from the steering system is dependent upon the proficiency of a user, personal preference, and running style (a grip run or a drift run). Thus, there is a need in the art for an improved steering system for radio controlled vehicle which provides stable drive maintaining the vehicle maneuverability and flexibility to adjust the level of assist according to user's proficiency and preference.

In view of the above mentioned situation, one object of one or more aspects of the present invention is to provide a steering control system for a radio controlled vehicle which does not deteriorate vehicle maneuverability.

Another object of one or more aspects of the present invention is to provide a steering control system for a radio controlled vehicle which provides a variable level of assist and/or the level of assist is user definable or selectable.

The foregoing objects have been achieved by a steering control system for a radio controlled vehicle comprising: an angular speed sensor unit having a detection axis to detect an angular velocity about the detection axis, and a processing unit. The processing unit is configured to: receive a first steering signal from a receiver of the radio controlled vehicle which indicates a position of a control stick or a control wheel of a controller for the radio controlled vehicle, quantify the first steering signal, receive a signal from the angular speed sensor, and quantify the signal from the angular speed sensor so as to generate an assist amount.

The processing unit can be further configured to retrieve a first assist factor corresponding to the position of the control stick or the control wheel which the received first steering signal indicates, adjust the assist amount by multiplying the assist amount by a first assist factor, add the adjusted assist amount to the quantified first steering signal to generate a second steering signal, and send the second steering signal to the actuator for the steering mechanism of the radio controlled vehicle, upon receiving the first steering signal.

In some configurations, the first assist factor corresponding to the position where the control stick or the control wheel is at a neutral position may be set to 1, and the first assist factor may be decreased as the control stick or the control wheel is moved away from the neutral position in either direction. In some configurations, the first assist factor corresponds to the position where the control stick or the control wheel is fully moved in either direction or in the vicinity thereof may be set to 0.

The processing unit or steering control system may further comprise a memory unit to store at least one set of assist factors or a set of first assist factors wherein each first assist factor associated with the position of the control stick or the control wheel thereby defining a pattern of assist factors, which can be a predetermined pattern of assist factors. The memory unit could also store one or more algorithms that can be used to calculate an assist factor, which preferably corresponds to the position of the steering input (e.g., control stick or control wheel). Accordingly, the use of the phrases "set of assist factors" or "predetermined pattern" are intended to include look-up tables or algorithms, unless otherwise indicated or made clear via the specific context. The memory units may store a plurality of sets of first assist factors. The processing unit may further comprise a selector, such as a physical or electronic selection switch, to allow a user to select the predetermined pattern. The processing unit may be further configured to receive a signal from the controller for the radio controlled vehicle through the receiver to select the predetermined pattern.

The processing unit may be further configured to generate a second assist factor, which is determined based on the historical data regarding the applied assist amounts. By comparing the most recent assist amount data and the previous data, it can be seen whether if the angular speed is on the increase or on the decrease. If the angular speed is on the decrease, the adjusted assist amount may be reduced by multiplying the first assist factor by the second assist factor, whose value is below "1".

Yet, another object of one or more aspects of the present invention is to provide a radio controlled car comprising the steering control system which ensures a stable drive while maintaining the vehicle maneuverability.

Still another object of one or more aspects of the present invention is to provide a radio controlled car comprising the steering control system which assists users according to their proficiency and preference.

These and additional objects are accomplished by the various aspects of the present invention, wherein briefly stated, one aspect is a use of the aforementioned steering control system for a radio controlled vehicle.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and the structural changes may be made without departing from the scope of the invention. The accompanying drawings, therefore, are submitted merely as showing the preferred exemplification of the invention. Accordingly, the following detailed description is not to be taken in a limiting sense, and the scope of the present invention is best defined by the appended claims.

BRIEF DESCRIPTION OF DRAWINGS

Figure 1:
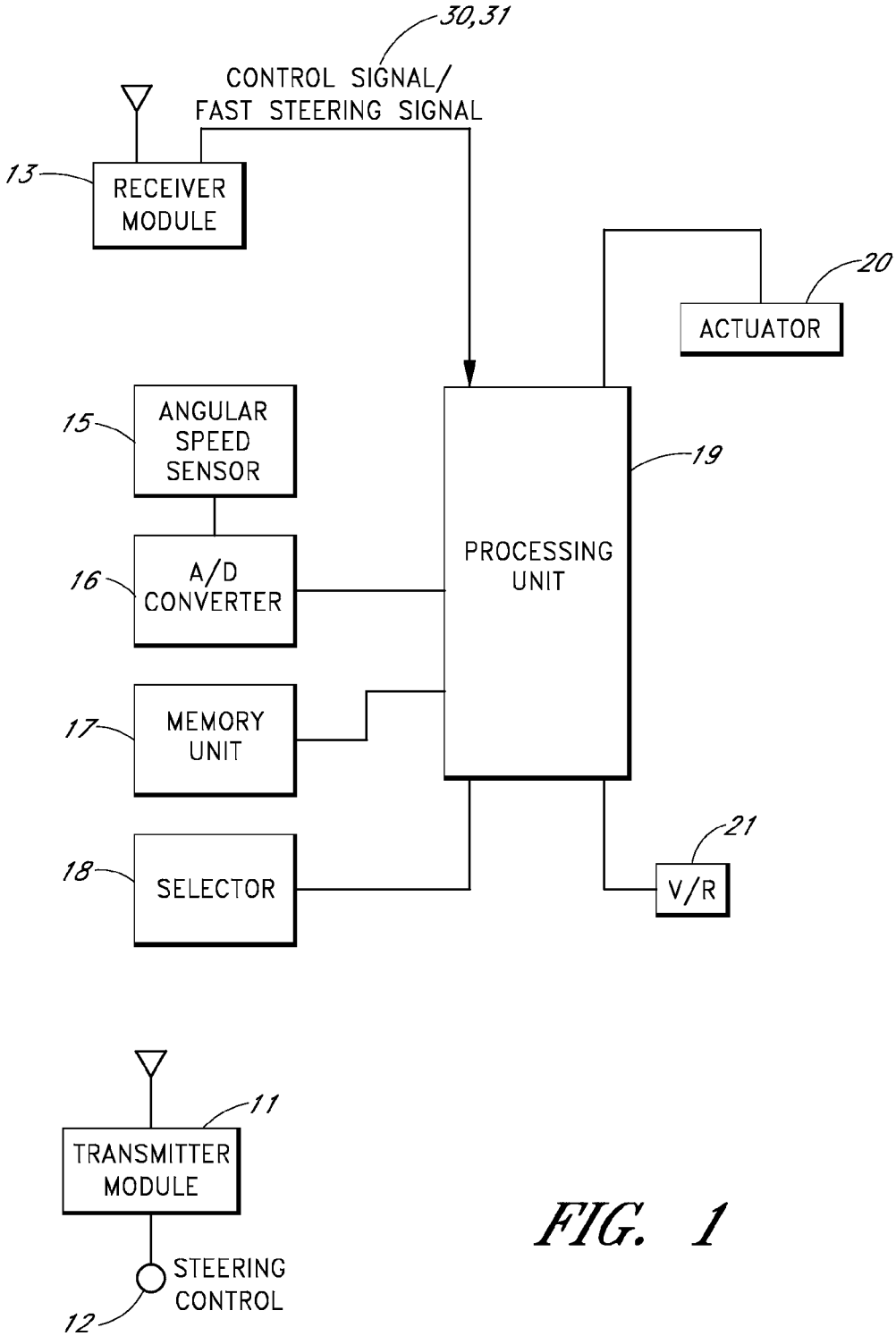

Having thus described the invention in general terms, reference will now be made to the accompanying drawings, which are not necessarily drawn to scale, and wherein:

FIG. 1 shows schematically a block diagram of a steering control system for a radio controlled vehicle according to one exemplary embodiment of the present invention.

Figure 2:
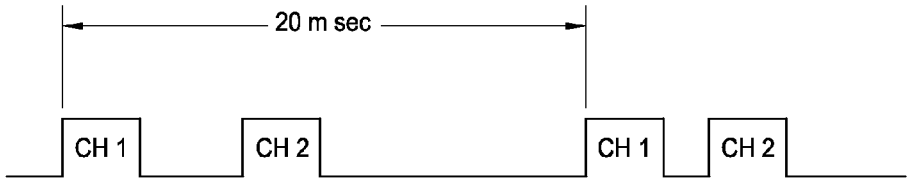

FIG. 2 shows a pulse signal stream from the receiver module.

Figure 3:
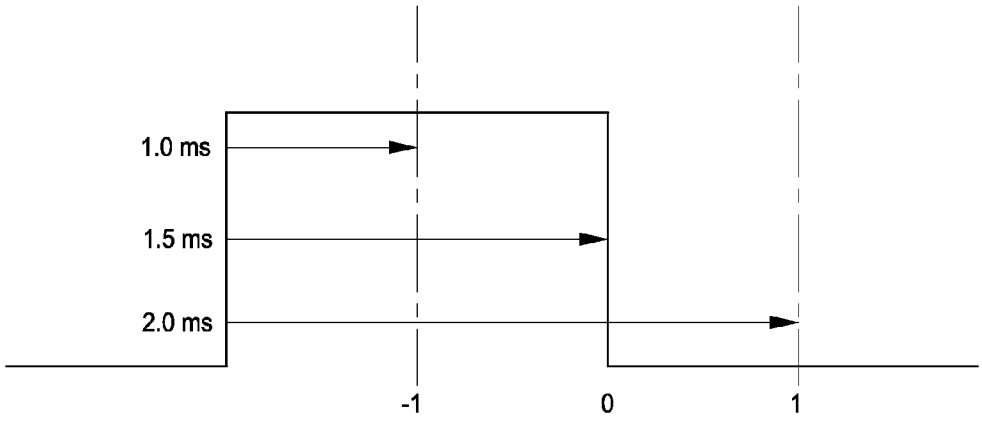

FIG. 3 shows the first steering control pulse signal.

FIG. 4*a*, FIG. 4*b*, FIG. 4*c*, and FIG. 4*d* show a transitional pattern of the value of the first assist factor by location of the steering control.

Figure 5:
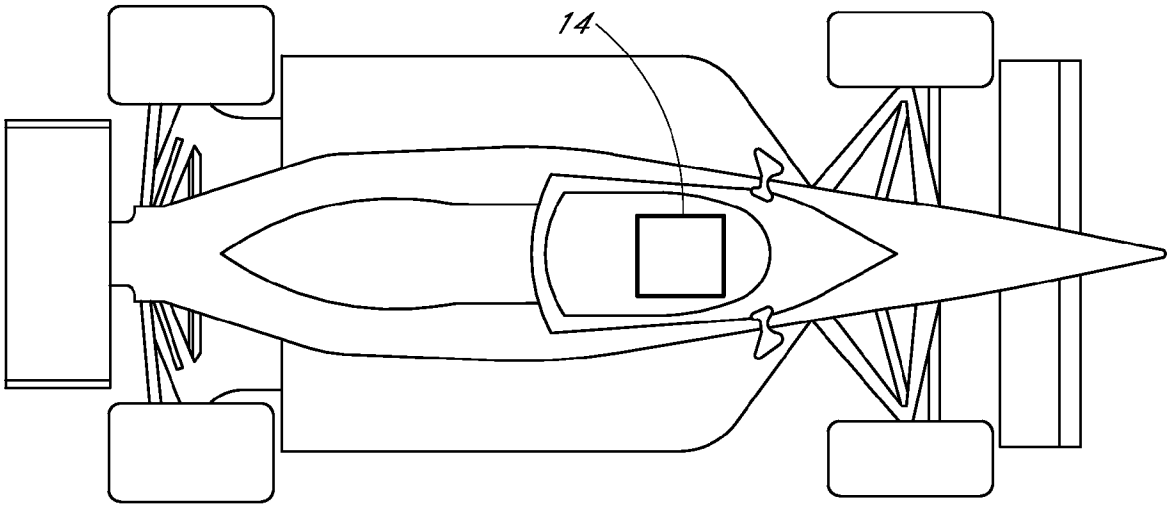

FIG. 5 shows a radio controlled car having a steering control system installed.

DETAIL DESCRIPTION OF THE INVENTION

In the following detailed description of the present invention, numerous specific details are set forth in order to provide a through understanding of the present invention. However, it will be obvious to one with ordinary skill in the art that the present invention may be practiced without these specific details. In other instances, well known methods, procedures, components, and mechanisms have not been described in detail as not to unnecessarily obscure aspects of the present invention. While the following detailed description of the present invention is related to a radio controlled car, it is to be appreciated that the present invention and its principles are also applicable to many other vehicles as well.

Unless defined otherwise, all technical and scientific terms used herein have the same meaning as is commonly understood by one skill in the art. Hereafter, an apparatus of the present invention will be described in detail by way of a preferred embodiment shown in the attached drawings.

The word "exemplary" is used herein to mean "serving as an example, instance, or illustration." Any embodiment described herein as "exemplary" is not necessarily to be construed as preferred or advantageous over other embodiments.

FIG. 1 illustrates a block diagram of a remote or radio control system 10, which comprises a steering control system 14 in accordance with an embodiment of the present invention. The steering control system is installed, for example, on a radio controlled car. As used herein, "radio controlled" or "remote controlled" are used in accordance with their ordinary meaning in the art. Thus, unless otherwise indicated or made clear by context, the phrases are intended to cover suitable communication systems or protocols for operating a vehicle or the like using a controller that is remote from the vehicle and, in the usual case, is not physically connected to the vehicle. Although, in exemplary embodiments, the radio controlled system 10 is described using in the radio controlled car, the radio controlled system 10 may operate with any type of radio controlled vehicle. The radio controlled system 10 includes a transmitter module 11 having a steering control 12. The steering control 12 may be a control stick, a control wheel, or any other suitable arrangement for providing a steering or directional control input. In many configurations, the steering control 12 will also include additional control inputs, such as speed control, for example. The steering control system 14 may comprise an angular speed sensor 15 having a detection axis to detect an angular velocity about the detection axis, a variable resistor 21 to control sensitivity of the sensor, an A/D converter 16, memory unit 17, and a processing unit 19, and these components may be installed on a single substrate. The angular speed sensor 15 may comprise a gyroscope.

The steering control system 14 is installed on the radio controlled car as shown in FIG. 5, along with a receiver module 13 and an actuator 20 for a steering mechanism of the radio controlled vehicle. The actuator 20 can be any suitable type of actuation device or arrangement for the given application, such as turning the steerable wheels of a vehicle or otherwise positioning a directional control arrangement. The angular speed sensor 15 is mounted on a car body such that detection axis is oriented in substantially same direction with a direction of gravitational force. However, the angular speed sensor 15 may be mounted on the car body such that detection axis has an angle with respect to the direction of gravitational force using adjustable platform (not shown), so that the sensitivity of the sensor can be adjusted.

The receiver module 13 receives a radio signal transmitted from the transmitter module 11 and sends a corresponding control signal 30, which comprises a first steering signal 31, to a processing unit 19. The control signal 30 is a pulse stream signal periodically sent from the receiver module 13 in a certain interval as shown in FIG. 2. In FIG. 2, a control signal for 2 channels having 20 ms period is illustrated, and either CH1 or CH2 signal may be the first steering signal 31.

In a conventional use, the control signal 30 is directly applied to the actuator 20 for the steering mechanism of the radio controlled car. Then, the actuator 20 is activated so as to set front wheels angle of the car to desired angle according to a width of the pulse signal. For example, as shown in FIG. 3, a signal having 1.5 ms pulse width activates the actuator 20 to set the front wheels angle in a neutral (straight) position, a narrower pulse activates the actuator 20 to steer the front wheels to left, and a wider pulse activates the actuator 20 to steer the front wheels to left. Thus, the front wheel angle is controlled by changing the pulse width from 1.0 ms to 2.0 ms, and the pulse width is determined by a position of the steering control 12 on the transmitter module 11. When the steering control 12 is at a neutral position, the first steering signal 31 having a 1.5 ms signal width is generated, when the steering control is fully moved to left, the first steering signal 31 having a 1.0 ms pulse width is generated, and when the steering control is fully moved to right, the first steering signal 31 having a 2.0 ms signal width is generated. Accordingly, the first steering signal 31 uniquely indicates the position of the steering control 12 in an essentially or nearly continuous manner.

However, in at least some embodiments of the present invention, the control signal 30, including the first steering signal 31, is sent to the processing unit 19. After the control signal 30 is obtained, the processing unit 19 quantifies the obtained signal according to the signal width utilizing a timer function of the processing unit 19. An exemplary embodiment is shown in FIG. 3. The signal having 1.5 ms pulse width, which activates the actuator 20 to move the front wheel in the neutral position, is assigned the value of "0". The signal having 1.0 ms pulse width, which activate the actuator 20 to move the front wheel fully to left, is assigned the value of "−1". A signal having 2.0 ms pulse width, which activates the actuator 20 to move the front wheel fully to right, is assigned the value of "1". The signals having the pulse width therebetween are assigned the value which is proportional to the signal width. For example, the pulse having 1.25 ms pulse width is assigned the value of "−0.5", and the pulse having 1.80 ms pulse with is assigned to the value of "0.6", which activates the actuator 20 to move the front wheel between the neutral position and the fully moved to right position. The above is by way of example and the actual values can differ.

The processing unit 19 also receives a signal from the angular speed sensor 15 through an AD converter module 16 (if necessary) and quantifies the signal so as to determine an assist amount. The signal from the angular speed sensor 15 is quantified to act on the actuator 20 for the steering mechanism of the radio controlled car to steer in a direction opposite to that of the detected angular velocity, which is often referred to as "counter-steering."

In the exemplary embodiment, the processing unit 19 essentially or nearly continuously receives the signal from the angular speed sensor 15 through the AD converter module 16 (if necessary) and quantifies the signal and the results are stored in the memory unit 17 or the processing unit 17, as the assist amount. A signal receiving cycle from the angular speed sensor 15 through the AD converter module 16 is substantially shorter than a receiving cycle of the control signal 30. The assist amount is renewed with a new result as the processing unit 19 continuously quantifies the signals from the angular speed sensor 15 through the AD converter module 16. A plurality of the assist amounts may be stored in the memory unit 17 or the processing unit 17.

In the exemplary embodiment, the assist amount is determined such that: when no angular speed is detected by the angular speed sensor 15, a value of "0" is assigned to the assist amount; when the angular speed sensor 15 detects a right turn velocity about the detection axis, a negative value is assigned to the assist amount; and when the angular speed sensor 15 detects a left turn velocity about the detection axis, a positive value is assigned as the assist amount. The maximum value of the assist amount can be greater than "1".

After the processing unit 19 receives the first steering signal 31 and quantifies the signal, the quantified first steering signal is associated with an assist amount, such as the most recent assist amount. Conventionally, the assist amount is merely added to the quantified first steering signal and a second steering signal is generated so as to stabilize a movement of the radio controlled car. In this manner, it is effective to stabilize the car when the radio control car is forced to move sideways by an external force such as a strong wind or a contact with other cars while driving straight. However, as the angular speed sensor detects intentional maneuvers as well, the car is always in an under-steer condition and deteriorates vehicle maneuverability.

Therefore, with present invention, the assist amount is adjusted by multiplying the assist amount by a first assist factor before being sent to the actuator 20 as a second steering signal, so that the vehicle maneuverability is maintained. The first assist factor ranges from, preferably, value of "1" to "0", however, the maximum value of the first assist factor can be more than "1" and the minimum value of the first assist factor can be more than "0", depending upon the sensitivity of the angular speed sensor, or weight of the car. A set of first assist factors is stored in the processing unit 19 or in the memory unit 17.

Figure 4A:
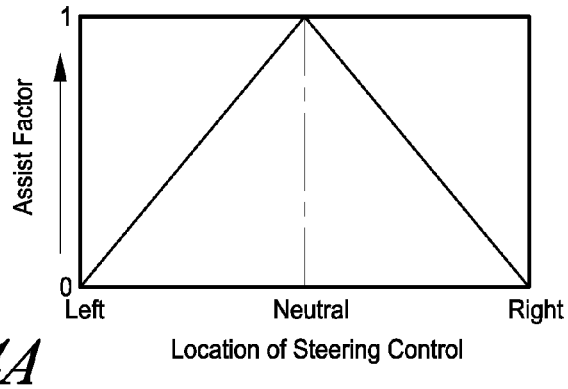

Each first assist factor is associated to a location of the steering control 12 indicated by the first steering signal 31. For example, a value of "1" is assigned to the first assist factor when the first steering signal 31 indicates that the steering control 12 is in a neutral position, and a value of "0" is assigned to the first assist factor when the first steering signal 31 indicates that the steering control is fully moved in either direction. The value of the first assist factor assigned between the neutral position and the end-of-range positions is related to, such as directly proportional to, the distance from the neutral position. FIG. 4*a* illustrates a transitional pattern of the value of the first assist factor by position of the steering control 12 of the above example. As indicated in the figure, the first assist factor is decreased as the steering control 12 is moved away from the neutral, so that the assist amount added to the first steering signal 31 is decreased as well and no assist amount is added when the steering control is fully moved. Accordingly, the maneuverability such as a larger minimum turning radius is not deteriorated.

Figure 4B:
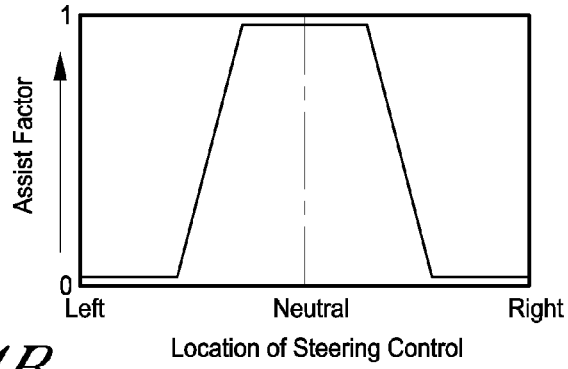
Figure 4C:
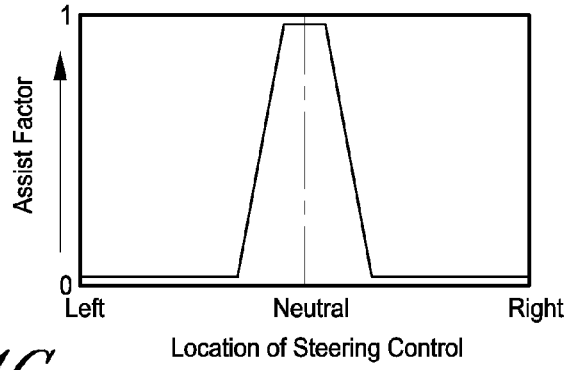
Figure 4D:
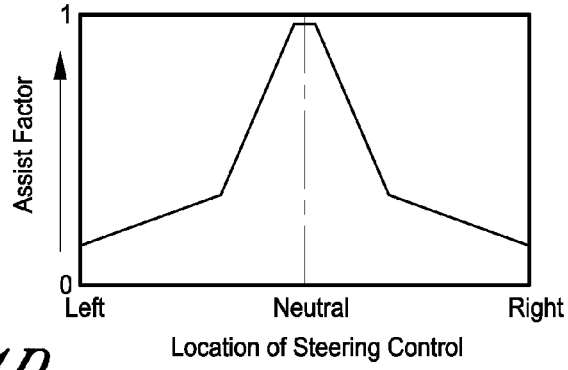

A plurality of sets of the first assist factors can be stored in the processing unit 19 or the memory units 17. Each set of the first assist factors may have a unique transitional pattern of the value of the first assist factor by the position of the steering control 12, as indicated in FIGS. 4*b*, 4*c*, and 4*d*. A user can select one of the available set of first assist factors based on a proficiency or preference. Experienced users may choose the set represented by FIG. 4*b* or FIG. 4*c*, which provides the assist only in a limited range which is close to the neutral position, and novices may choose the set represented by FIG. 4*a* or FIG. 4*d*, which provides the assist in overall range. The processing unit 19 may further comprise a selector to select one of the available set of first assist factors or the processing unit 19 is further configured to receive a signal from the transmitter module for the radio controlled vehicle through the receiver module 13 to select one of the available sets of first assist factors (which can be referred to as "assist modes").

Thus, as described, the second steering signal is generated based on a sum of the adjusted assist amount (assist amount× first assist factor) and the quantified first steering signal. In another exemplary embodiment, the adjusted assist amount is further multiplied by a second assist factor, which is determined based on the plurality of the assist amount data. The processing unit 19 may comprise a First-In-First-Out (FIFO) data structure so as to store most resent plurality of the assist amount data. By comparing the most recent assist amount data and the previous data, it can be seen whether if the angular speed is on the increase or on the decrease. The second assist factor ranges from, preferably, "1" to "0", however, the maximum value of the first assist factor can be more than 1, depending upon the sensitivity of the angular speed sensor, weight of the car, or a degree of change of the angular speed. For example, if the angular speed is found to be on the increase, the adjusted assist amount is multiplied by "1", and if the angular speed is found be on the decrease, the adjusted assist amount is multiplied by a value below "1". Thus, the adjusted assist amount can be fine-tuned based on the second assist factor.

Either, utilizing the second assistant factor or not, the processing unit 19 limits the value of the second steering signals to be within a mechanical capability of the steering mechanism, which ranges "1" to "−1", to prevent an overload of the actuator or other damage.

The apparatus and the method of the present invention have been described in detail. However, the present invention is not limited to the above embodiments and may be variously altered or changed as long as it does not depart from the gist of the present invention.

What is claimed is:

1. A steering control system for a radio controlled vehicle comprising:

an angular speed sensor having a detection axis to detect an angular velocity about the detection axis, and a processing unit, wherein the processing unit is configured to:

receive a first steering signal from a receiver of the radio controlled vehicle which indicates a position of a steering control of a controller for the radio controlled vehicle, quantify the first steering signal, receive a signal from the angular speed sensor, quantify the signal from the angular speed sensor so as to generate an assist amount, wherein the signal from the angular speed sensor is quantified to act on an actuator for the steering mechanism of the radio controlled vehicle to steer in a direction opposite to that of the detected angular velocity, retrieve an first assist factor corresponding to the position of the steering control which the received first steering signal indicates adjust the assist amount by multiplying the assist amount by the first assist factor, add the adjusted assist amount to the quantified first steering signal to generate a second steering signal, send the second steering signal to the actuator for the steering mechanism of the radio controlled vehicle.

2. The steering control system for a radio controlled vehicle according to claim 1, wherein the first assist factor corresponding to the position where the steering control is at a neutral position is set to a first value, and wherein the first assist factor is decreased as the steering control is moved away form the neutral position in either direction.

3. The steering control system for a radio controlled vehicle according to claim 2, wherein the first assist factor corresponding to the position where the steering control is fully moved in either direction or in the vicinity thereof is set to 0.

4. The steering control system for a radio controlled vehicle according to claim 2, wherein the processing unit further comprising a memory unit to store a set of first assist factors wherein each first assist factor is associated with the position of the steering control.

5. The steering control system for a radio controlled vehicle according to claim 4, wherein a plurality of sets of first assist factors are stored in the memory unit.

6. The steering control system for a radio controlled vehicle according to claim 5, wherein the processing unit further comprises a selector to select one of the available sets of first assist factors.

7. The steering control system for a radio controlled vehicle according to claim 5, wherein the processing unit is further configured to receive a signal from the controller for the radio controlled vehicle through the receiver to select the set of first assist factors.

8. The steering control system for a radio controlled vehicle according to claim 1, wherein the angular speed sensor comprises a gyroscope.

9. The steering control system for a radio controlled vehicle according to claim 1, further comprising a variable resistor to adjust a sensitivity of the angular speed sensor.

10. The steering control system for a radio controlled vehicle according to claim 1, further comprising a substrate, wherein the angular speed sensor unit and the processing unit are mounted on the substrate.

11. A radio controlled car comprising the steering control system for a radio controlled vehicle according to claim 1.

12. The radio controlled car according to claim 11, wherein the steering control system is mounted on a vehicle body such that detection axis is oriented in substantially same direction with a direction of gravitational force.

13. A method for steering a radio controlled vehicle comprising:

receiving a first steering signal from a receiver of the radio control vehicle which indicates a position of a steering control of a controller for the radio controlled vehicle, quantifying the first steering signal, receiving a signal from the angular speed sensor, quantifying the signal from the angular speed sensor so as to generate an assist amount wherein the signal from the angular speed sensor is quantified to act on an actuator for the steering mechanism of the radio controlled vehicle to steer in a direction opposite to that of the detected angular velocity, retrieving an first assist factor corresponding to the position of the steering control which the received first steering signal indicates, adjusting the assist amount by multiplying the assist amount by an first assist factor, adding the adjusted assist amount to the quantified first steering signal to generate a second steering signal, sending the second steering signal to the actuator for the steering mechanism of the radio controlled vehicle.

14. The method for steering a radio controlled vehicle according to claim 13, further comprising selecting a set of first assist factors wherein a plurality of sets of first assist factors are stored in the memory unit.

* * * * *